US007674136B2

(12) United States Patent
Steinke et al.

(10) Patent No.: US 7,674,136 B2
(45) Date of Patent: Mar. 9, 2010

(54) MODULAR JACK CONNECTOR SYSTEM

(75) Inventors: Stephan Steinke, Brackenheim (DE); Sven Filipon, Heilbronn (DE); Wolfgang Herrmann, Munich (DE); Michael Hartmann, Neudenau (DE)

(73) Assignee: Molex Incorporated, Lisle, IL (US)

( * ) Notice: Subject to any disclaimer, the term of this patent is extended or adjusted under 35 U.S.C. 154(b) by 226 days.

(21) Appl. No.: 10/597,434

(22) PCT Filed: Jan. 25, 2005

(86) PCT No.: PCT/US2005/000703

§ 371 (c)(1),
(2), (4) Date: Mar. 25, 2008

(87) PCT Pub. No.: WO2005/076413

PCT Pub. Date: Aug. 18, 2005

(65) Prior Publication Data

US 2009/0098766 A1 Apr. 16, 2009

(30) Foreign Application Priority Data

Jan. 28, 2004 (DE) ..... 20 2004 001 202 U

(51) Int. Cl.
*H01R 24/00* (2006.01)

(52) U.S. Cl. ..... 439/676; 439/541.5

(58) Field of Classification Search ..... 439/676, 439/541.5, 620.18
See application file for complete search history.

(56) References Cited

U.S. PATENT DOCUMENTS

| | | | | |
|---|---|---|---|---|
| 5,269,708 | A * | 12/1993 | DeYoung et al. | 439/676 |
| 5,741,152 | A * | 4/1998 | Boutros | 439/490 |
| 6,179,650 | B1 | 1/2001 | Chih-Kai | |
| 6,206,725 | B1 | 3/2001 | Wu | |
| 6,511,348 | B1 | 1/2003 | Wojtacki et al. | |
| 6,641,440 | B1 | 11/2003 | Hyland et al. | |
| 6,659,807 | B1 | 12/2003 | Zheng et al. | |
| 2003/0087559 | A1 | 5/2003 | Korsunsky et al. | |
| 2003/0139091 | A1 | 7/2003 | Kamarauskas et al. | |

* cited by examiner

*Primary Examiner*—Michael C Zarroli
(74) *Attorney, Agent, or Firm*—Stephen L. Sheldon

(57) ABSTRACT

Modular electrical jack connector system comprising at least one jack connector housing and at least one therein inserted jack connector subassembly wherein each jack connector housing comprises a front coupling side having at least two openings which openings are disposed one above the other to receive a variety of electrical plug connectors through the front coupling side and an oppositely disposed rear side for insertion of at least one jack connector subassembly wherein further each jack connector subassembly comprises a longitudinal strip-like carrier having a substantially right-angled profile and further on the upper side and on the lower side respectively a series of extrusion-coated or injection-molded jack terminals which at a front end of the strip-like carrier form uncoated, bent-back cantilevered contact portions.

27 Claims, 8 Drawing Sheets

MODULAR JACK CONNECTOR SYSTEM

FIELD OF THE INVENTION

The invention relates to a modularly constructable jack connector system for the provision of a variety of jack connectors with a variety of connection jacks or ports and particularly for use in Ethernet networks.

BACKGROUND OF THE INVENTION

There are known circuit connector arrangements having a variety of connection jacks within a common housing for the provision of a basically compact jack connector arrangement. In addition a specified number of jacks in a vertically stacked and/or adjacently strung arrangement are conventionally provided within a common external housing, a so-called stacked jack arrangement. In general the jack connectors comprise for this purpose a housing having plug connector-receiving openings wherein are disposed electrical terminal contacts for the production of a connection with a received complementary plug connector wherein the electrical terminal contacts are often inserted into the housing from one of the oppositely disposed sides with respect to one of the plug connector-receiving openings by means of modular jack sub-assemblies. Such jack connectors for example form modularly constructed jacks of the type RJ-45 or for example of the type RJ-11 for the purpose of producing connections with correspondingly complementarily formed RJ-45 or RJ-11 plug connectors.

Such connecting systems are also common alongside telephone distribution networks for example in other computer or automation networks wherein are encompassed a variety of data transfer media including coaxial cables, fibre optic cables and telephone cables. Such a network topography is known e.g. as an Ethernet network and is subject to various electrical standards such as for example IEEE 802.3 and others. Such networks must provide a high number of distributed connections and the connecting systems may conventionally occupy only a small space due to progressive miniaturisations in order to provide a variety of different connections.

Since such networks are further operated at high rates of one gigabyte and higher a further requirement is a significant conditioning of the signals to be transferred. Shielding is therefore normally necessary in order for example to provide a so-called Common Mode Rejection (CMR) and to guarantee a specified electromagnetic compatibility (EMC) and/or resistance to electromagnetic disturbance. For the purpose of conditioning the signals it is therefore further necessary to incorporate within the arrangement corresponding components such as particularly magnet coils but also capacitive components in order to correspondingly condition the signals.

The printed publication U.S. Pat. No. 6,511,348 B1 discloses one such genre-forming modular jack connector arrangement having an external shield housing around a jack connector housing wherein is insertable a variety of modular jack subassemblies. The modular jack subassemblies respectively comprise in accordance with the printed publication a longitudinal strip-like carrier whose upper and lower sides receive a variety of adjacently strung jack terminals. In addition the strip-like carrier is formed with channels on its upper and lower sides which channels are laterally delimited by ribs and wherein the jack terminals are positioned. On a front end of the strip-like carrier are bent back respective contact portions of the electrical jack terminals that are disposed in the channels which contact portions are held in which slots that extend vertically from respectively the upper and lower sides and communicate with the channels.

The jack terminals extend with their respectively oppositely disposed end with respect to the contact portion into a laterally disposed with respect to the strip-like carrier printed circuit board and there correspondingly form contact connections wherein above and below these contact connections of the printed circuit board and above and below the strip-like carrier are received signal conditioning components. The jack subassemblies are adjacently disposed in the jack connector housing and separated from one another by shield plates. Above and below each strip-like carrier is defined a plug connector receptacle in the jack connector housing in which plug connector receptacle the terminal contacts are disposed above and below the strip-like carrier.

Substantial disadvantages herein are that due to the arrangement of the electrical jack terminals in the channels that are formed between the ribs and including the contact portions that are held in the slots the production both of the strip-like carrier as well as the jack terminals but also the assembly of the two components places maximum demands on accuracy since otherwise an interlocking of the terminals and contacts within the ribs and/or the slots will occur. However even in the case of a high production quality and assembly accuracy a rubbing of the terminals and contact portions on the ribs and in the slots is not completely excluded and this can consequently lead to a premature wearing including associated maintenance and/or repair costs. A further substantial disadvantage of the modular jack connector arrangement in accordance with the US publication is that the number of jack connectors for the provision of a variety of connection jacks by means of the use of a common jack connector housing is specified such that hereby only a limited possible variation of jack connectors is guaranteeable and/or for different applications are to be provided respectively specific jack connector housings which provision leads to a further cost increase particularly with respect to the production and storage.

An object of the invention consequently consists of providing a new and substantially improved modular jack connector structure with respect to the prior art and particularly for use in the case of Ethernet networks whereby can be provided fast and cost effectively and in a maximally flexible manner a space-saving modular jack connector system comprising a corresponding number of jack connectors and consequently connection jacks or ports with respect to the respective specific requirements and wherein for the manufacture and the assembly a substantially simplifying construction of a jack terminal retaining arrangement is guaranteed.

SUMMARY OF THE INVENTION

The object according to the invention is solved in an extremely surprising manner by a subject comprising the features of an attached independent claim.

Beneficial and/or preferred embodiments and further embodiments are the subject of the sub-claims.

In accordance with the invention a modular electrical jack connector system is thereby provided which modular electrical jack connector system comprises at least one jack connector housing and at least one therein inserted jack connector subassembly wherein the jack connector, housing can be expediently strung together with at least one further jack connector housing and is connectable to said further jack connector housing wherein each jack connector housing comprises a front coupling side having at least two openings which openings are disposed one above the other for the purpose of receiving a variety of electrical plug connectors through the front coupling side and an oppositely disposed with respect to the front coupling side rear side for the purpose of inserting at least one jack connector subassembly wherein further each jack connector subassembly comprises a longitudinal strip-like carrier having a substantially right-angled profile and further on the upper side and on the lower side respectively a series of extrusion-coated or injection-molded jack terminals which extrusion-coated jack terminals at a front end of the strip-like carrier form uncoated, bent-back cantilevered contact portions such that the bent-back series of contact portions of the inserted jack connector subassembly on one side is disposed such that it is aligned in the upper opening and the bent-back series of contact portions on the oppositely disposed side is disposed such that it is aligned in the lower opening.

The jack connector system according to the invention thereby guarantees an extremely flexible substantially infinitely extendable number of jack connectors by way of the space-saving modular stringing together of a variety of jack connector housings wherein moreover as a result of the extrusion-coated or injection-molded jack terminals and the completely uncoated bent-back cantilevered contact portions the jack terminals are permanently definably fixed and particularly with reference to the contact portions and even in the case of only minimally retained production tolerances an interlocking and/or a premature wearing due to friction on guiding/fixing ribs or grooves is substantially completely excluded.

A particularly preferable embodiment provides that each jack connector housing is moulded out of a plastic material and is formed for the purpose of receiving respectively one jack connector subassembly.

In accordance with a preferred further embodiment is further inserted between each individual adjacently strung jack connector housing a metallic shield as a result of which metallic shield no additional insulation of the shield is required thus leading to a further cost saving.

In accordance with a preferred further embodiment the strip-like carrier is constructed particularly for the purpose of flexible fabrication out of two respectively vertically disposable carrier halves wherein each half comprises an extrusion-coated arrangement of jack terminals.

Preferably the extrusion-coating of the jack terminals forms a bump or knuckle-like thickening towards the uncoated area of the contact portions which bump or knuckle-like thickening defines an end stop for the contact portions whereby is ensured in the case of each contact with a counter plug connector a permanent pre-stressing of the contact portions.

A shield plate is disposed sandwich-like between two carrier halves for the purpose of further increasing the shield values and as a consequence no further insulation is required since each series of jack terminals is carried by a strip-like carrier half and is thereby already insulated by the extrusion-coated plastic material.

In a further beneficial embodiment the strip-like carrier halves are identically formed such that a cost-effective manufacture of the whole strip-like carrier is guaranteed and wherein the strip-like carrier halves comprise complementarily formed engaging devices for a simple assembly of respectively two strip-like carrier halves to form one strip-like carrier.

The jack connector subassembly is insertable in a jack connector housing and further comprises in a preferred embodiment correspondingly adapted components for the purpose of signal conditioning such as particularly magnet coils which magnet coils are disposed in accordance with the application at least adjacently with respect to a top surface of the strip-like carrier. Due to the extrusion-coated or injection-molded jack terminals and the preferable inserting of respectively one jack connector subassembly into respectively one jack connector housing there is substantially required no further insulation material for the jack connector-subassembly or the signal conditioning components.

The jack connector subassembly is further preferably formed such that a variety of different conditioning components is modularly connectable to said jack connector subassembly and particularly compatible for this purpose are box-like modules e.g. magnet boxes having four to twelve coils.

A standard jack connector comprises in accordance with a preferable embodiment a jack connector jack connector subassembly having ten signal pins. For the provision of inline power supply the jack connector subassemblies according to the invention are further formed with two additional pins for 48 Volts per connection port.

The mechanical fixture and all jack connector subassembly encompassed parts and components and their interconnecting electric circuitry is carried out by the jack connector subassembly preferably via two separated circuit boards and particularly printed circuit boards between which can be disposed particularly the strip-like carrier and the box-like modules. Further electric/electronic components can be moreover disposed on the outside of the carrier plates wherein the carrier plates for the purpose of electrical circuitry comprise corresponding contact arrangements such as particularly contacting openings for respective contact ends and/or pin ends.

In a further preferred embodiment is further provided the fitting of the jack connector subassembly with LED pins wherein further for a simple assembly are expediently disposed on the carrier plates LED's which LED's radiate at right-angles and whose light can be guided forward to the front coupling side via wave-guides which wave-guides are attached to the carrier plates. The wave-guides are further received in accordance with a preferred further embodiment in the guiding channels that are formed in the jack connector housing.

Per jack connector subassembly there is hereby guaranteed in the simplest manner at least up to eight additional LED functionalities and in other words four per connecting port.

In a particularly beneficial embodiment the variety of adjacently strung jack connector housings is disposed on at least one earth plate and particularly a printed circuit board which circuit board comprises openings for the purpose of receiving signal pins that are guided out of the jack connector subassembly. In addition to the corresponding application-specific electrical connecting of the signal pins for the purpose of connecting circuitry there is hereby brought about a mechanical positioning of the signal pins and an additional shield element is provided. Depending on the dimensioning of the earth plate this simultaneously acts as a carrier for further electric/electronic components. Should the earth plate comprise a sandwich-like multi-layer structure there is provided in accordance with a beneficial further embodiment a capacitor effect particularly for the purpose of further improved interference signal filtering.

The adjacently strung jack connector housings are moreover disposed for the purpose of further improved shield in an external shield housing which external shield housing substantially fully encompasses the jack connector housing and is preferably soldered to the earth plate for the provision of a well-shielded system.

In a further preferred embodiment moreover each employed jack connector subassembly is soldered directly to the external shield such that minimum transfer resistances are ensured which minimum transfer resistances lead particularly to once more substantially improved EMC and/or CMR values.

The external shield is hereby preferably constructed in two-parts and comprises a first portion which first portion is connectable from the front coupling side of the jack connector housing to said jack connector housing and a second shield portion which second shield portion is solderable to said first shield portion and which is placeable from the rear of the jack connector housing onto said jack connector housing.

In this case the external shield housing is prefabricated corresponding to the desired number of adjacently strung jack connector housings and is formed with a corresponding number of cutouts of the from the front coupling side attachable shield portion which cutouts are aligned with the for the purpose of receiving plug connectors provided openings of the jack connector.

For the purpose of adjacently stringing the jack connector housings said jack connector housings comprise complementarily formed attaching devices wherein there can be provided that the concluding jack connector housings at either end of the string and in other words the first and the last jack connector housings in the string are specifically formed for the purpose of arrangement within the external shield. At least the intermediately strung and/or intermediately stringable jack connector housings are however identically structured in accordance with a preferred embodiment.

The invention is hereafter described in further detail on the basis of preferred embodiments with reference to the attached drawings.

DETAILED DESCRIPTION OF PREFERRED HOWEVER ONLY EXEMPLIFIED EMBODIMENTS

Reference is made first to the FIGS. 1 to 4 wherein is shown in perspective view a modular jack connector system according to the invention for use in the case of Ethernet networks in un-assembled and in assembled states from respectively two different and with respect to the horizontal. substantially mirrored angles of vision.

Figure 1:
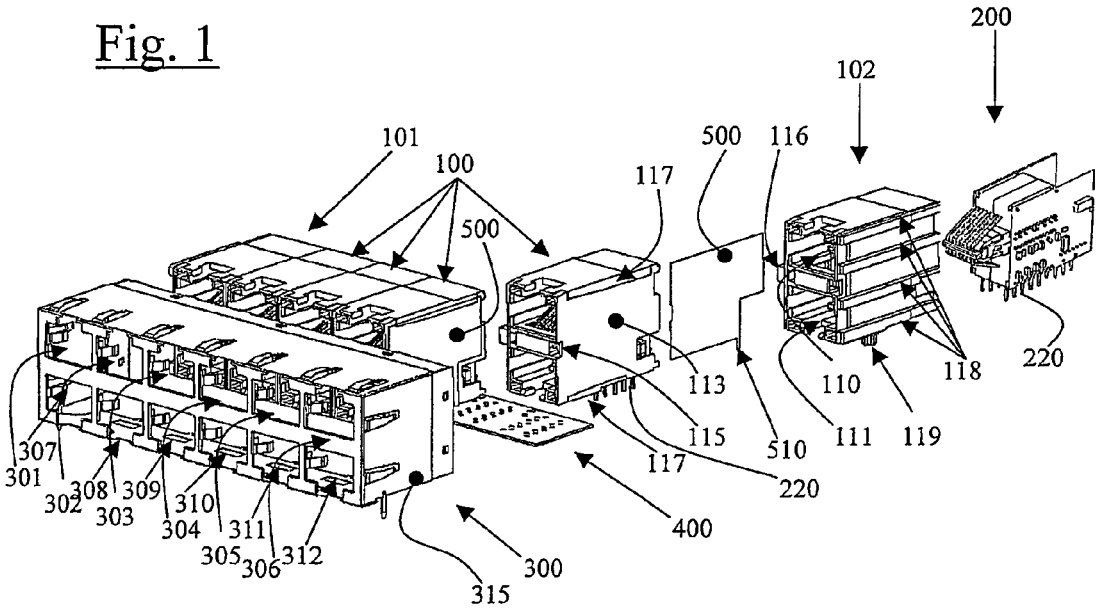
FIG. 1 shows an exploded front perspective view from a raised angle of vision of a jack connector system according to the invention in a partially assembled state.
Figure 2:
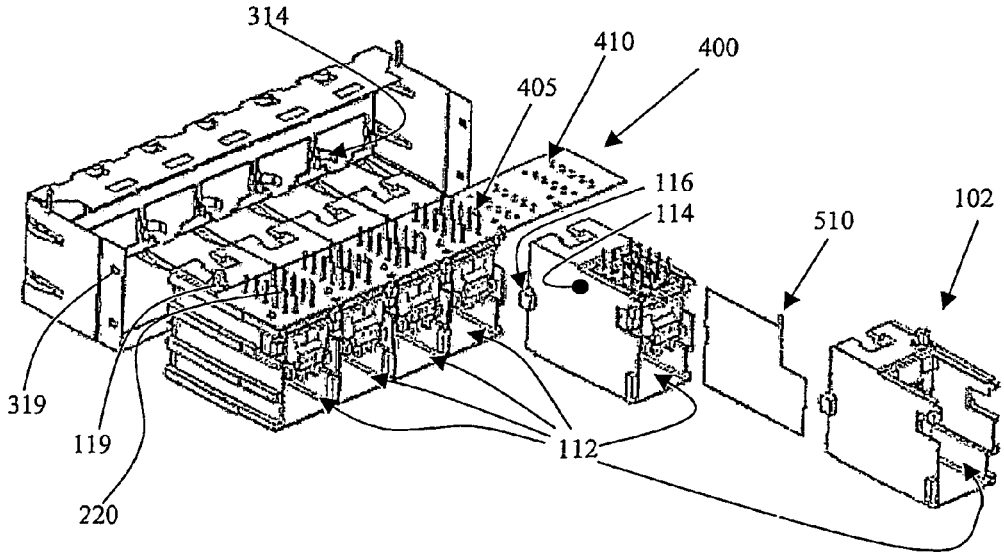
FIG. 2 shows a horizontal mirror image of the jack connector system according to the invention according to FIG. 1.

FIGS. 1 and 2 show a number of six, four centrally and two externally adjacently stringable moulded jack connector housings 100, 101 and 102 made of a plastic material. The jack connector housings 100, 101 and 102 respectively comprise a front coupling side having two vertically disposed plug connector-receiving openings 110 and 111. The oppositely disposed with respect to the front coupling side rear side 112 of the jack connector housing 100, 101 and 102 forms a substantially fully open side through which as separately described below a jack connector-subassembly 200 is insertable into a respective jack connector housing 100, 101 and 102.

The jack connector housings 100, 101 and 102 each comprise on their oppositely disposed lateral side surfaces 113 and 114 an engaging device 115 and/or 116 for the purpose of lateral stringing which engaging devices 115 and/or 116 are developed complementarily with respect to one another. For the purpose of laterally stringing the jack connector housings 100, 101 and 102 is formed an on the lateral side 114 of each jack connector housing an engaging device 116 which engaging device 116 thereby operates with the engaging device 115 which engaging device 115 is formed on the oppositely disposed side 113 of an adjacently disposed jack connector housing.

Expediently moreover are formed grooves 117 on substantially one of each lateral side and in the present example on the side 113 of the jack connector housings 100 and 101 and at their upper and lower ends which grooves 117 extend between the front coupling side and the rear jack connector housing side 112 and wherein further a vertically aligned metallic shield plate 500 in accordance with FIGS. 1 and 2 is insertable and is correspondingly disposable between the respective individual jack connector housings 100, 101 and 102.

Since the respective modularly stringable jack connector housings 100, 101 and 102 are made of an insulating material no separate insulation is necessary for the shield plate 500.

The respectively concluding jack connector housings 101 and 102 in the string of jack connector housings 100, 101 and 102 are disposed at the start or the end of the string and said concluding jack connector housings 101 and 102 moreover comprise in the case of the present exemplified embodiment on their in the assembled state respectively outwardly facing sides assembly ribs 118 in order to guarantee a simplified inserting of the jack connector housings 100, 101 and 102 into a common external metallic shield 300 and to therein retain the jack connector housings 100, 101 and 102 that are inserted in the external shield 300 by means of mechanical pre-stressing. Moreover the two external jack connector housings 101 and 102 comprise fixing pins 119 in order to mount the fully assembled modular jack connector system onto a not illustrated fixture. By means of the modular adjacent stringing of the individual jack connector housings 100, 101, 102 is particularly guaranteed a large variation potential with reference to the number of the individual jack connectors or connection jacks and/or ports to be provided with the modular jack connecting systems within a common external shield housing 300 such that in the case of the present embodiment respectively only the external shield 300 is to be formed in accordance with the desired number of jack connector housings 100, 101 and 102 to be received. The illustrated embodiment comprises four central jack connector housings 100 and two external jack connector housings 101 and 102 and its external shield 300 comprises one of the number of twelve of the overall by the jack connector housings 100, 101 and 102 defined upper and lower plug connector-receiving openings 110 and 111 to which number of plug connector-receiving openings 110 and 111 corresponds the number of twelve cutouts 301 to 312 that are aligned with openings 110 and 111 such that, as can be seen particularly in the case of FIG. 3 wherein is illustrated the modular jack connector system in the mounted state, there is provided a total of twelve connection jacks or ports within the common external shield housing 300 which shield housing 300 comprises a front portion 310 and a rear portion 320. On the cutouts 301 to 312 are moreover provided inwardly curved into the connection jacks prestressed shield tabs 314 (FIG. 2, 3) for the plug connectors to be inserted.

The modular jack connector system according to the invention comprises in the case of the present embodiment moreover an earth plate 400 particularly in the form of a printed circuit board whereon the jack connector housing 100, 101 and 102 is disposed such that out of the inserted jack connector subassemblies 200 in accordance with the FIGS. 1 and 2 are guided outwardly extending signal pins in a vertical direction through correspondingly disposed through holes 410 in the earth plate 400 for an application-specific circuit connection. Moreover there is hereby guaranteed an additional mechanical positioning of the pins 220 in the mounted state of the modular jack connector system.

Each of the vertically between two jack connector housings 100, 101 and 102 insertable shield plates 500 comprises a thereon-formed pin-like projection 510 which pin-like projection 510 is simultaneously insertable in an opening 405 of the earth plate 400 which opening 405 of the earth plate 400 is provided for this purpose and is solderable to said earth plate in a preferred embodiment for improved shielding. The earth plate 400 thereby provides an additional shield element wherein the through openings 410 for the purpose of receiving the signal pins 220 are insulated from their surroundings apart from any strip conductors for the purpose of electrically connecting individual specific signal paths which strip conductors are not more closely illustrated.

In the case of the present embodiment the external shield 300 is structured in two portions and comprises a front portion 310 which front portion 310 is placeable from the front coupling side of the jack connector housing onto said jack connector housing and which front portion 310 comprises the cutouts 301 to 312 and further a rear portion 320 which rear portion 320 is connectable from the rear side of the jack connector housings 100, 101, 102 to the front portion 310. The front portion 310 and the rear portion 320 of the external shield 300 are formed in an overlapping area which overlapping area is provided for the purpose of assembly and which is formed with predefined projecting areas 319 and/or complementary cutout areas 322 by means of which projecting areas 319 and/or complementary cutout areas 322 the front portion 310 and the rear portion 320 are soldered together after assembly.

Moreover the earth plate 400 after assembly of the modular jack connector system is soldered to the external shield housing 300 whereon are formed in addition in the case of the illustrated embodiment on the rear external shield housing portion 320 corresponding soldering tabs 321 such that there is provided overall a very good outward shield.

Attention should be directed to the fact that the earth plate 400 can also project in accordance with its application beyond the external dimensions of the external shield 300 such that said earth plate 400 is also useable for example as a carrier for additional electrical/electronic components. Should the earth plate 400 moreover be produced as a compensation circuit board with a composite structure there is hereby achieved in addition a capacitor effect for the purpose of further improved interference filtering.

The rearward housing portion 320 of the external shield 300 moreover comprises for each received jack connector subassembly 200 a slightly inwardly curved pre-stressed soldering tab 325 whereby in a simple manner a direct soldering to a respective jack connector subassembly 200 encompassed metallic shield plate 270 (FIG. 9) can be brought about. By way of a thus brought-about direct earthing of the jack connector subassembly 200 are ensured minimum transfer resistances for a further improvement particularly of the EMC and CMR values.

Figure 5:
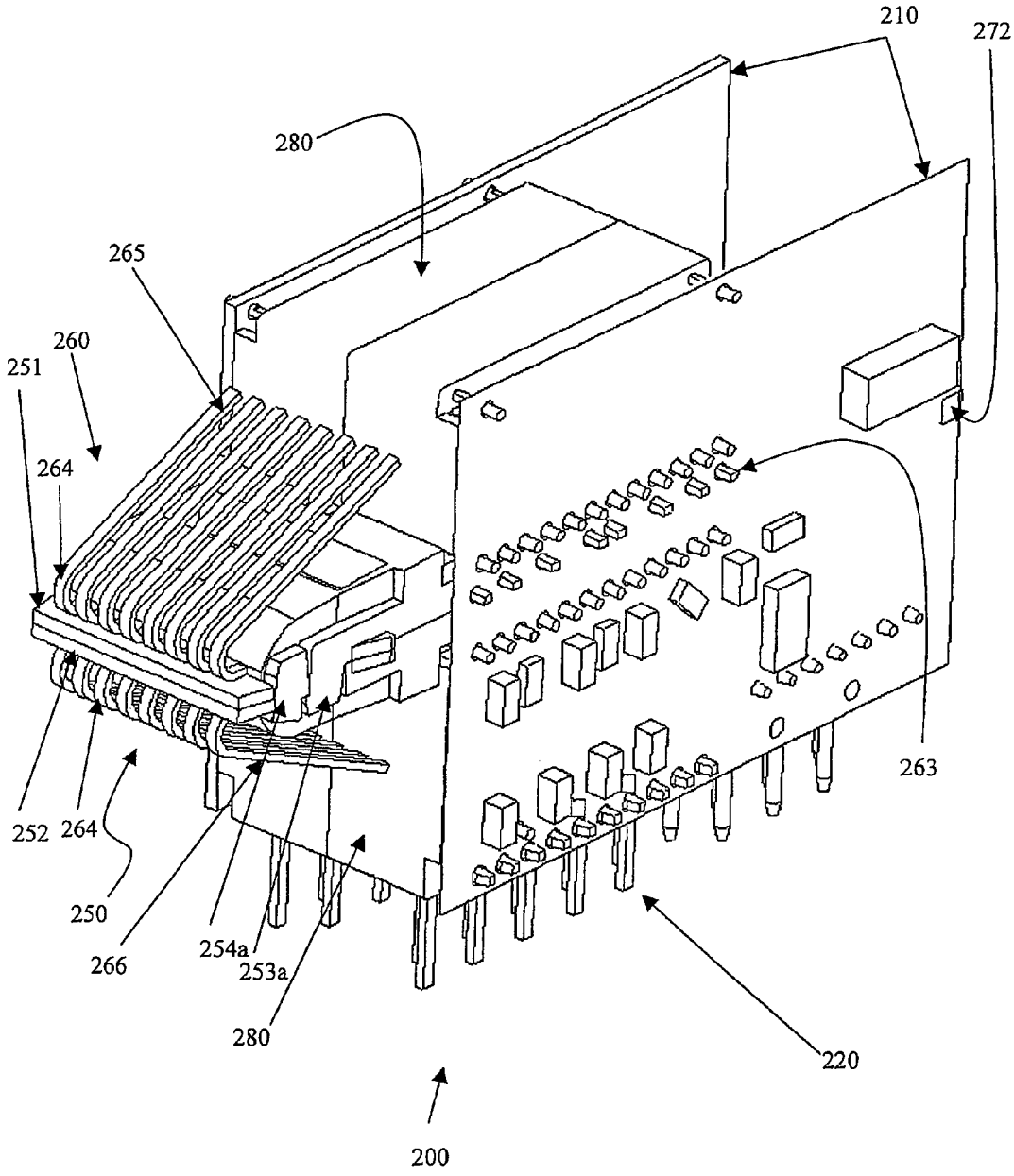
FIG. 5 shows an exploded front perspective view from a raised angle of vision of a first embodiment of a jack connector subassembly of the jack connector system according to the invention according to FIG. 1.
Figure 6:
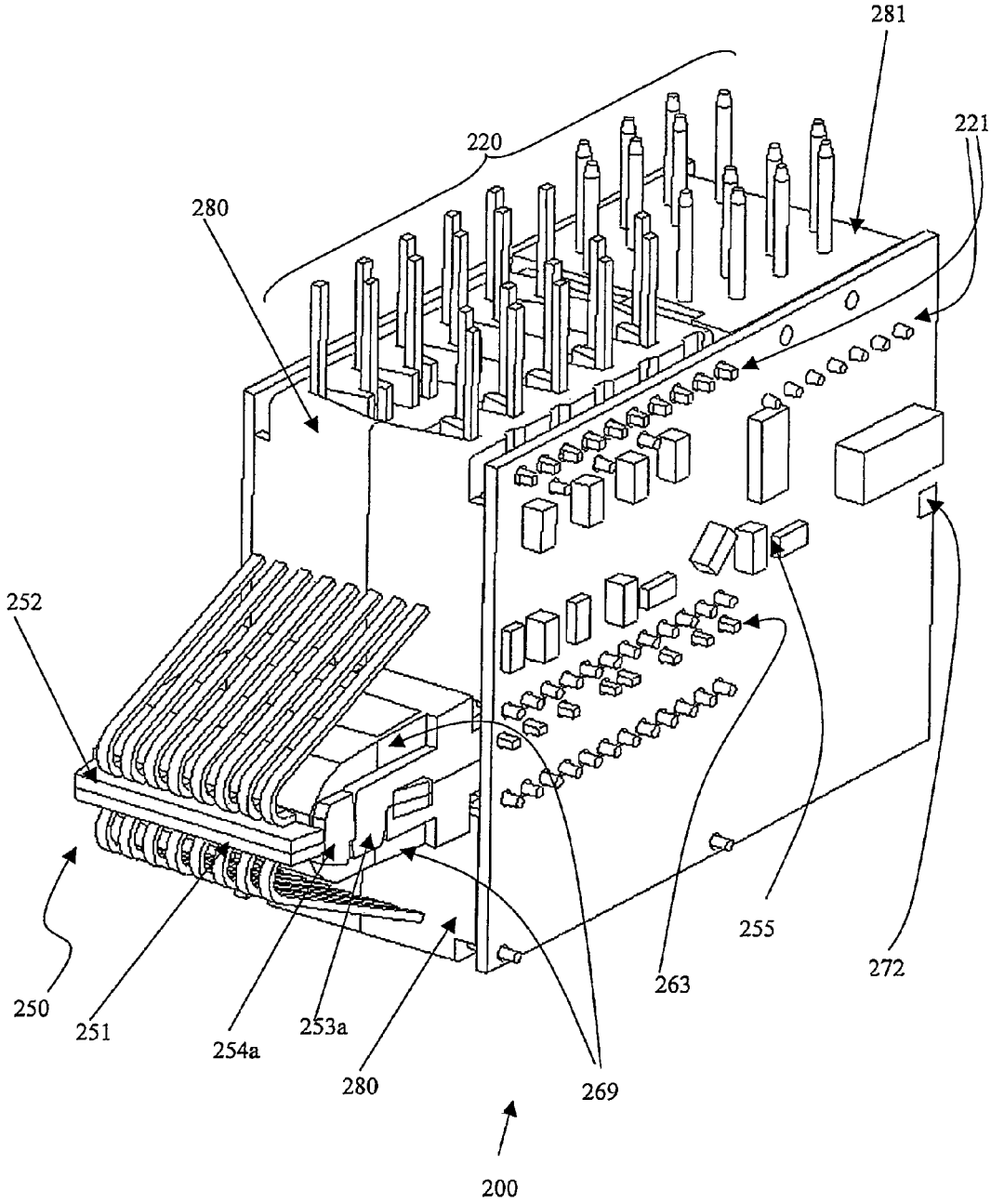
FIG. 6 shows the jack connector subassembly according to FIG. 5 in a 180° rotation around the longitudinal axis of the subassembly.
Figure 7:
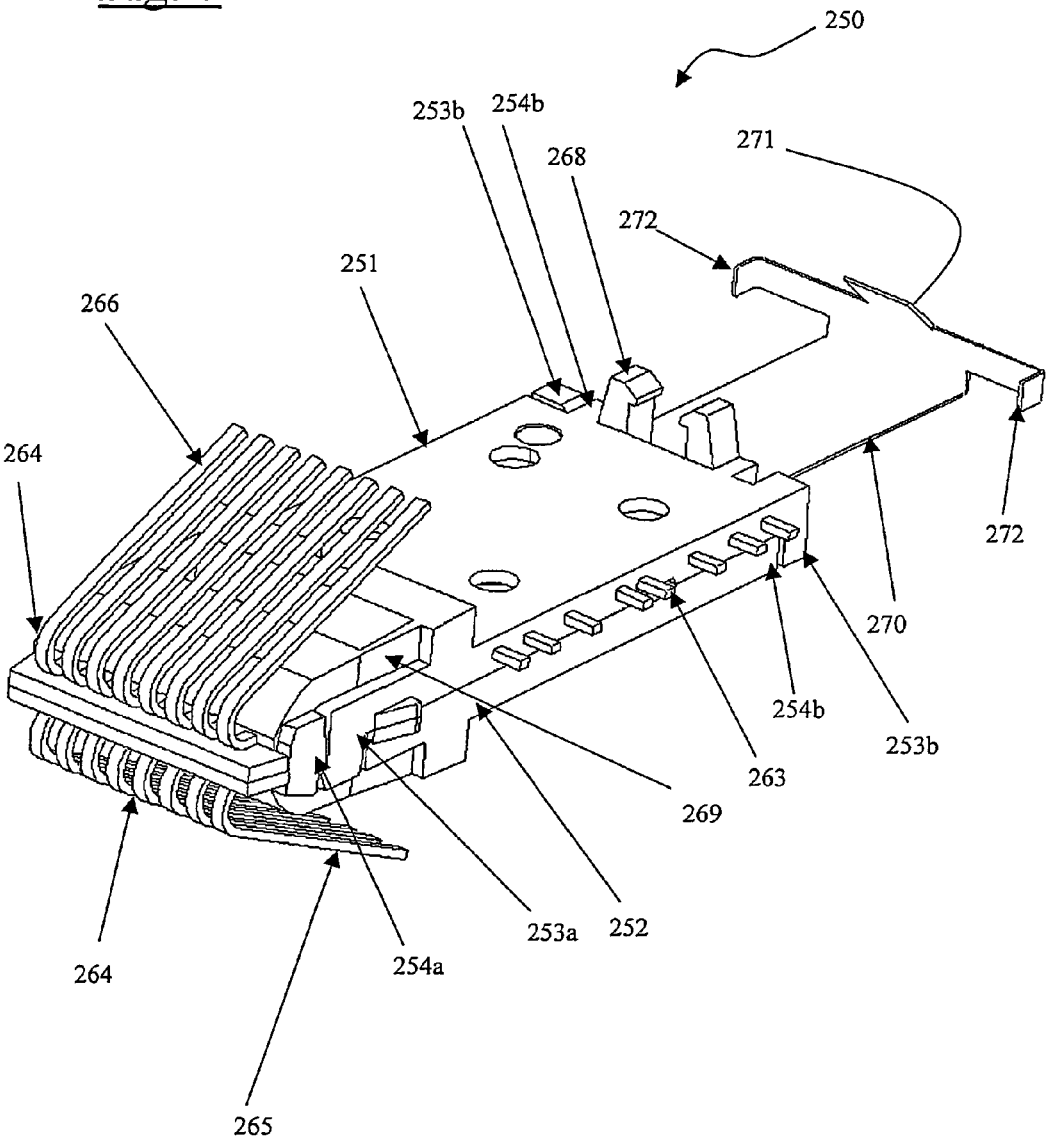
FIG. 7 shows a perspective view of a strip-like jack terminals carrier of the subassembly according to FIG. 5.

Reference is hereafter made particularly to the FIGS. 5, 6 and 7 wherein are illustrated in further detail substantial components of a jack connector-subassembly 200 according to the invention.

The illustrated jack connector-subassembly 200 according to the invention comprises two separated and aligned in parallel with respect to one another lateral carrier plates 210 which lateral carrier plates 210 comprise strip conductors for the purpose of electrically connecting individual specific signal paths which strip connectors are not described in further detail and signal conditioning components.

Between the two carrier plates 210 there extends in a vertical plane with respect to the planes of the carrier plates 210 a longitudinal strip-like carrier 250 made of a plastic material which longitudinal strip-like carrier 250 as described hereafter in further detail carries two rows of jack terminals 260 whereof respectively jack terminal contact portions 265 and 266 are correspondingly aligned in a mounted state in the plug connector-receiving openings 110 and 111 of a jack connector housing 100, 101 and 102 for the purpose of the contacting of terminal contacts of an inserted plug connector.

Above and/or below the strip-like carrier 250 is defined a space by means of the separated lateral plates 210 wherein are receivable box-like module inserts 280, 281 and particularly magnet box modules 280 for the purpose of rectifying the signals. According to the application there is provided that these magnet box modules 280 are prefabricated and comprise for example 2, 4, 8 or 12 coil cores.

In substance all signal pins 220 that are guided out of a jack connector subassembly 200 for the presently mentioned further circuit connection are substantially right-angled and extend respectively from a short pin end 221 which short pin end 221 is suitably connected via a respective connection through-hole of a carrier plate 210 to said carrier plate 210 for the purpose of electrical connection.

As can be particularly seen in FIGS. 5 and 6 on the respective outer sides of the carrier plates 210 are disposed a variety of further specifically wired electrical/electronic components 255. In the FIGS. 5 and 6 the pins that are guided out of the module insert 231 of the jack connector subassembly 200 moreover serve for the purpose of providing an inline power supply wherefore are provided per connection jack and/or port two pins for 48 volts as well as for the equipping of the jack connector subassembly 200 with an LED functionality for the purpose of the visual display of connection integrities.

The front portion 310 and the rear portion 320 of the external shield 300 are developed within an overlapping area with predefined projecting areas 319 and/or complementary cutout areas 322 which overlapping area is provided for the purpose of assembly.

The longitudinal strip-like carrier 250 is preferably constructed out of two identical carrier halves 251 and 252. Between stacked assembly surfaces of the two carrier halves 251 and 252 there is disposed and held sandwich-like a metallic shield plate 270. On each carrier half 251 and/or 252 there are formed respectively complementarily with respect to one another engaging devices 253*a*, 254*a* and 253*b*, 254*b* on two oppositely disposed lateral carrier sides which engaging devices 253*a*, 254*a* and 253*b*, 254*b* cooperate by placing the assembly surfaces of the carrier halves 251 and 252 on top of one another whereby is simply created an expediently releasable engaging and fixing of the stacked carrier halves 251 and 252.

Moreover each plastic material carrier half 251 and 252 carries a series of jack terminals 260 which jack terminals 260 are connected by way of extrusion-coating to the carrier half 251 and/or 252 and in the case of the illustrated embodiment of eight jack terminals. The extrusion-coated or injection-molded jack terminals 260 at their respective rear terminal ends 263 for the purpose of reception in one of the carrier plates 210 are guided laterally out of the carrier half 251 and/or 252 and embody up to their front jack terminal contact portions 265 and 266 an uncoated radius area 264. The front jack terminal contact portions 265 and 266 are similarly uncoated and are bent back over the radius area 264.

Figure 3:
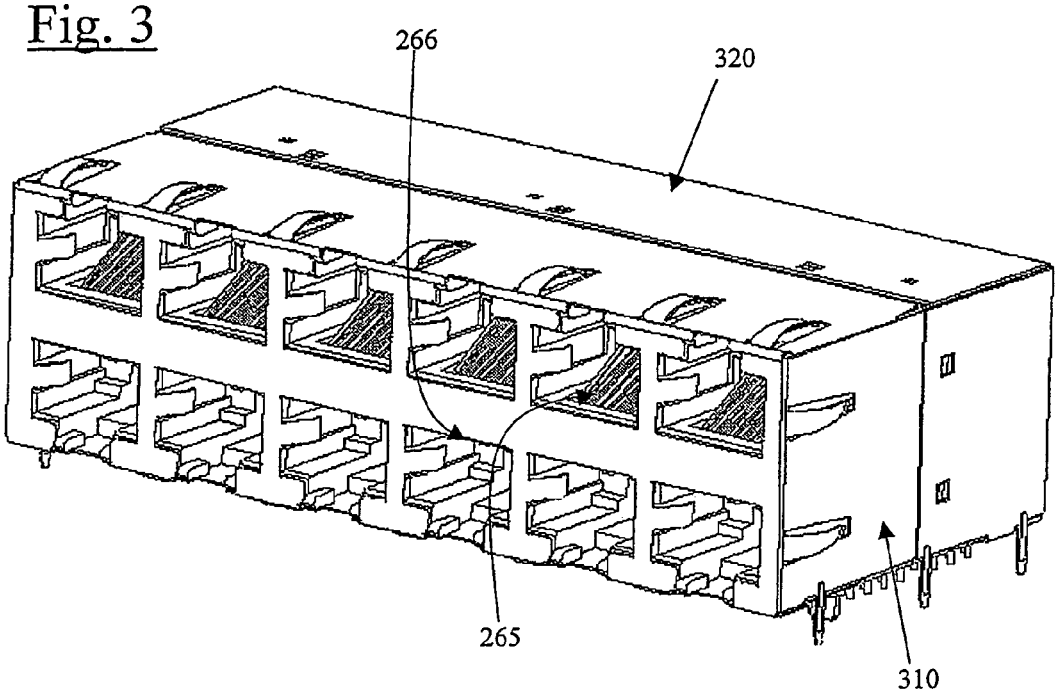
FIG. 3 shows the jack connector system according to the invention according to FIG. 1 in an assembled state.
Figure 4:
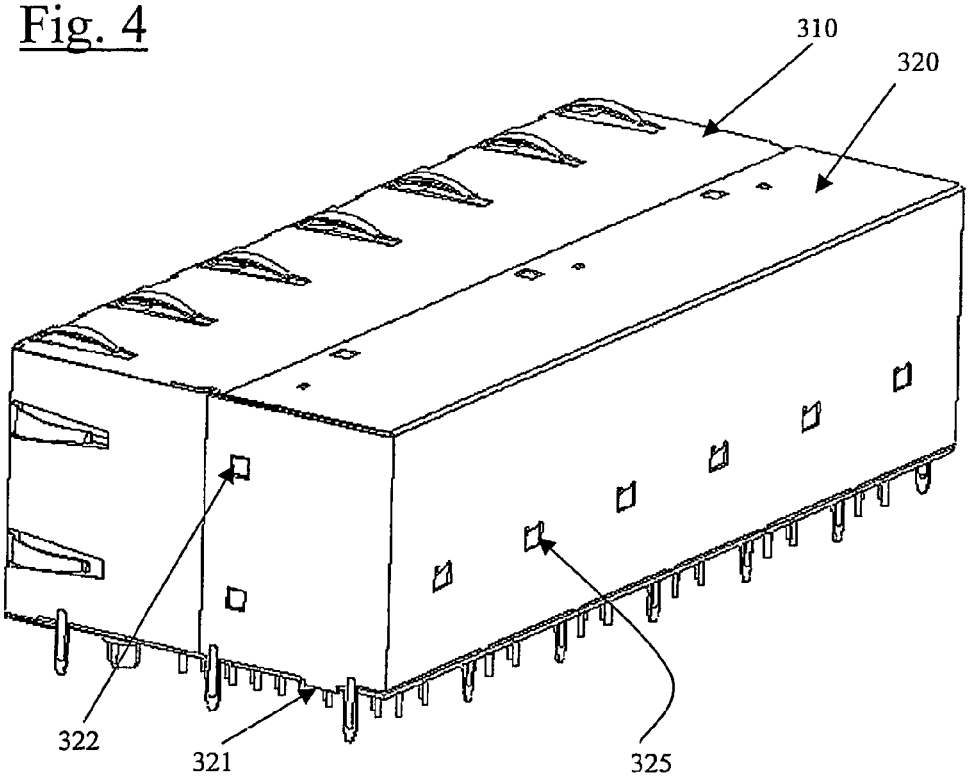
FIG. 4 shows a horizontal mirror image of the jack connector system according to the invention according to FIG. 3.

In the assembled and/or disassembled state of the two carrier halves 251 and 252 there hereby extend from the upper and from the lower sides of the strip-like carrier 250 respectively the bent-back contact portions 265 and/or 266 in a cantilevered manner. In the inserted state of a jack connector-subassembly in a jack connector housing 100, 101, 102 the series of contact portions 265 is hereby received and aligned in the upper plug connector receiving opening 110 of the jack connector housing in accordance with FIG. 1 and the inversely extending series of contact portions 266 is received and aligned in the plug connector-receiving lower opening 111 of the jack connector housing (FIG. 3).

The extrusion-coating of the jack terminals 260 at the front exit area of one respective carrier half 251 and/or 252 up to the radius area 264 moreover forms a type of bump or knuckle 269 whose height diminishes in the direction of the radius area 264 preferably while forming a radius. The bump or knuckle 269 thereby provides a stop for the contact portions 265 and/or 266 which contact portions 265 and/or 266 are bent back over the radius area 264 over the knuckle 269 in the inserted state in the event that said contact portions 265 and/or 266 are compressed in the event of a plug connector being inserted through the plug connector-receiving openings 110 and 111 in the direction of the knuckle 269 and thereby ensures a permanent pre-stressing of the contact portions 265 and/or 266.

On the carrier halves 251 and 252 are moreover formed fixing devices and/or fixing clips 268 in order to thereby fix the modularly insertable box inserts 280, 281 disposed between the lateral carrier plates 210.

The metallic shield plates 270 are held sandwich-like between the two carrier halves 251 and 252 and require no additional insulation due to the extrusion-coated or injection-molded jack terminals. The shield plate 270 comprises a rear soldering area 271 for the purpose of soldering to the outside rear of the shield housing portion 320 as described above as well as two laterally curved tabs 272 which laterally curved tabs 272 are connected to the two carrier plates 210 for the purpose of earthing.

Figure 8:
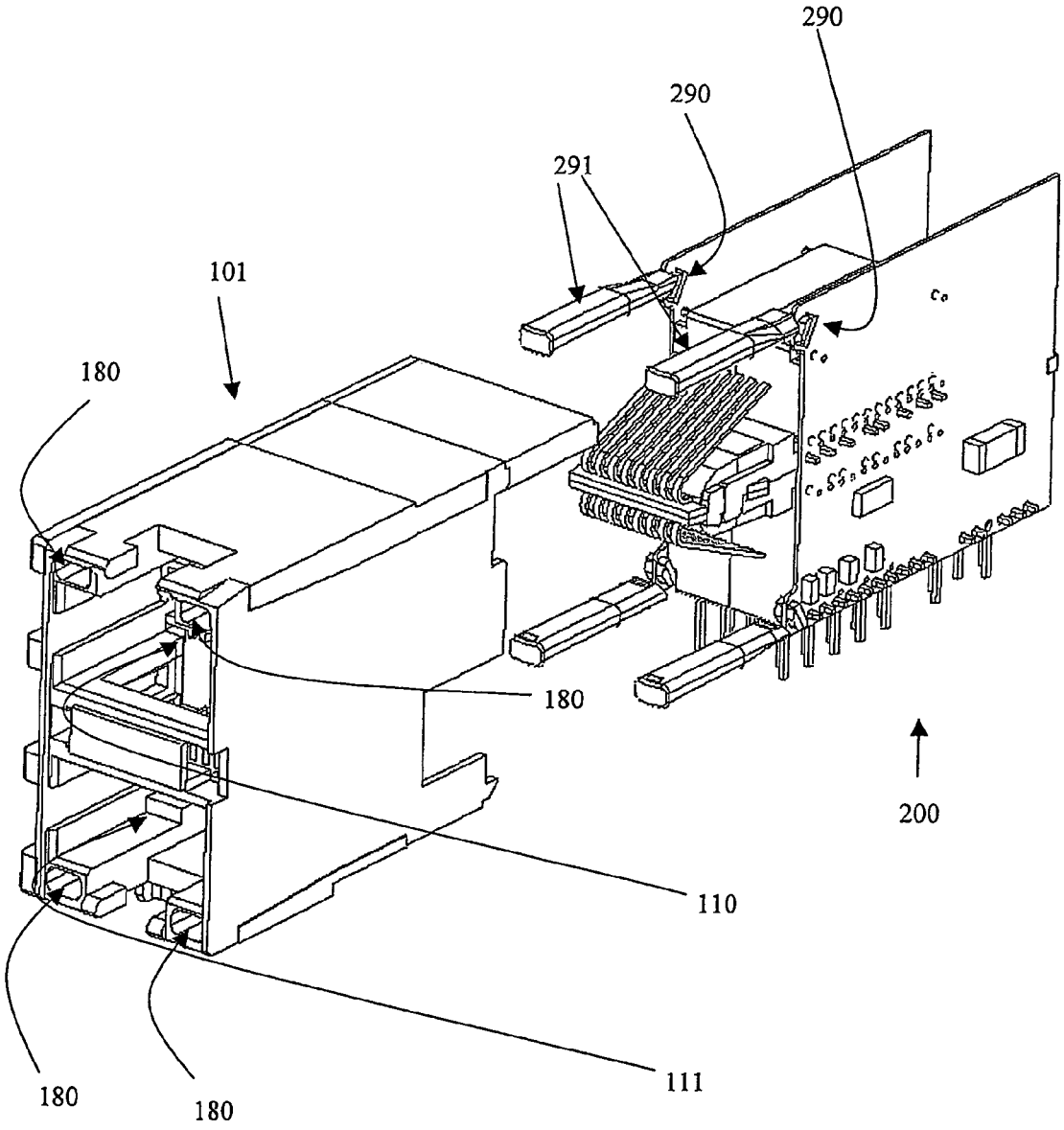
FIG. 8 shows an exploded front perspective view from a raised angle of vision of a jack connector housing and a second embodiment of a jack connector subassembly according to the invention with additional LED-functionality in an un-assembled state.
Figure 9:
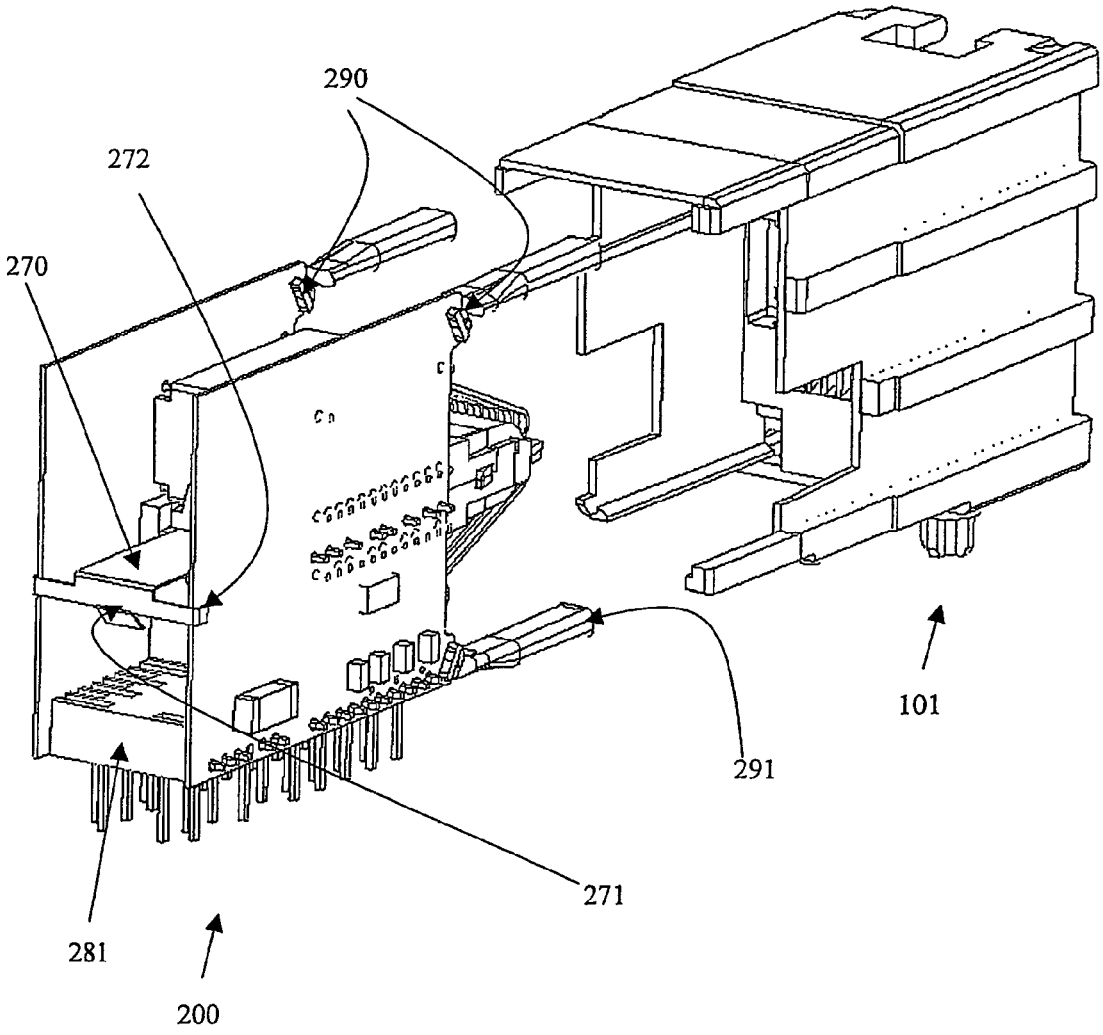
FIG. 9 shows a view rotated with respect to the view according to FIG. 8 by 180° around a vertical transverse axis of the subassembly and FIG. 10 shows a view of the jack connector housing and the jack connector subassembly according to FIG. 8, however with jack connector subassembly inserted into the jack connector housing.
Figure 10:
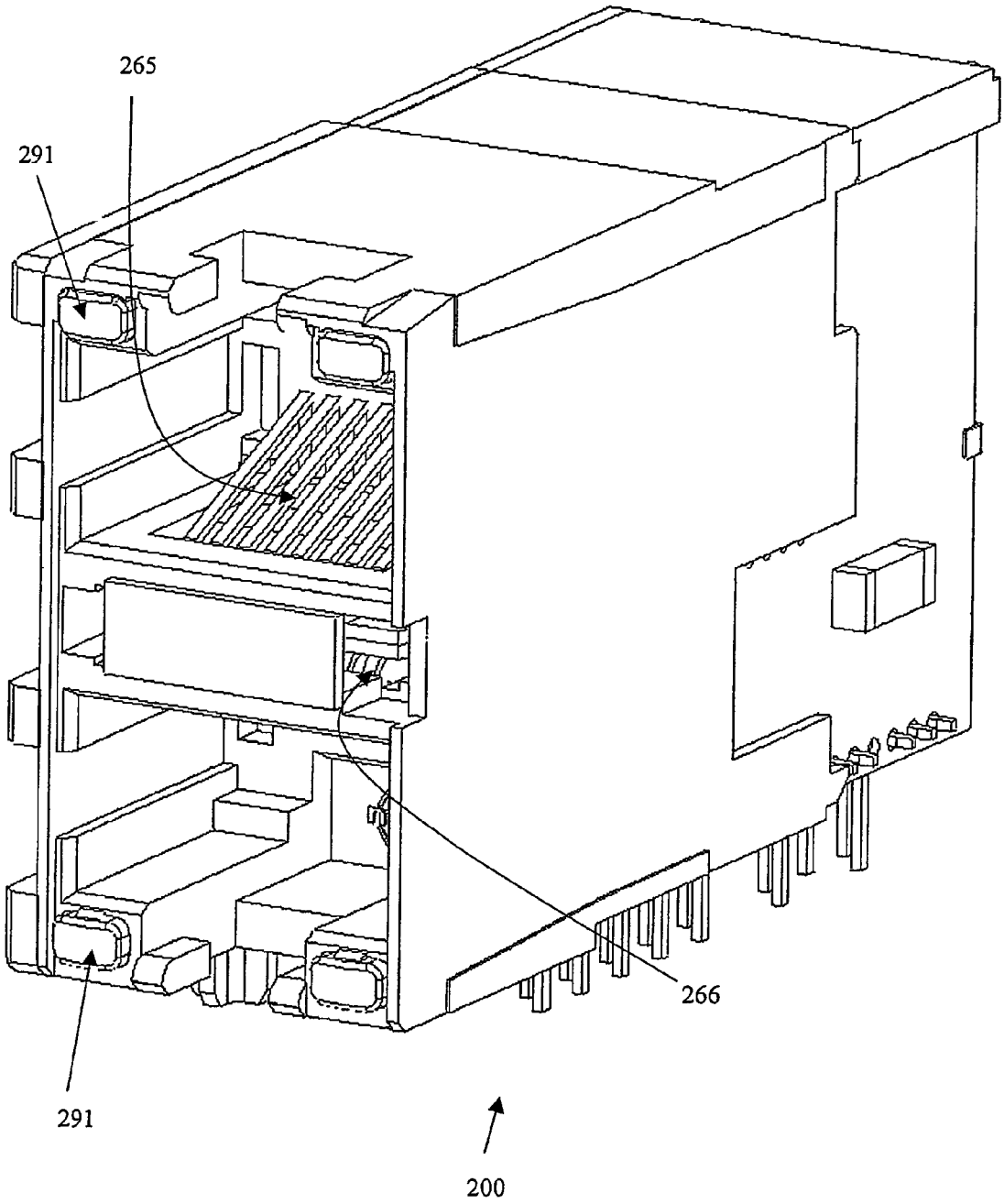

The jack connector subassembly 200 illustrated in the FIGS. 8 to 10 is equipped with the aforesaid LED-functionality and comprises for this purpose on each carrier plate 210 electrically actuated LED's 290 which electrically actuated LED's 290 in the case of the use of right-angular radiating LEDs are easily integrateable into the carrier plate such that the right-angular radiated light is guided forwards via the wave-guide 291 that is fastened to the carrier plates 210, i.e. towards the jack connector subassembly 200 receiving jack connector housing 101. The jack connector housings 100, 101 and 102 are expediently additionally formed for the purpose of receiving such wave-guides 291 with correspondingly aligned guide channels 180 in order to guide the radiated light visibly forward via the opening towards the plug connector-receiving openings 110 and 111 which plug connector-receiving openings 110 and 111 are defined by the wave-guide 291.

There is hereby provided that on each carrier plate 210 up to four LED's are connectable, i.e. respectively inside and outside at the upper and lower jack connector housing facing ends of a carrier plate 210. In the case of the illustrated embodiment the wave-guides 291 respectively comprise for two adjacently, i.e. internally and externally, disposed LED's 290 a common external sheathing. In the mounted state thereby for each connection port or connection jacks (FIG. 10) a maximum of four LED-functions are displayable.

The modular jack connector system according to the invention thereby guarantees due to the variety of modularly assemblable and expandable individual components the various fast and simple construction of a variety of different jack connectors in a space-saving and maximally outwardly shielded arrangement wherein particularly due to the extrusion coating-retained jack contacts and the respectively insulated jack connector housing modules additional insulation with respect to earth for intermediately located metallic shield devices is not necessary and consequently leads to a further cost saving.

Attention should be drawn to the fact that for an expert in the art electrically shielded jack connectors can suggest numerous application-specific modifications without abandoning the scope defined by the attached claims. In particular the application area is not limited to Ethernet-networks and the modularly constructed jack connectors of the jack connector system according to the invention can also provide different types of connecting ports within a jack connector system according to the invention.

REFERENCE LIST

100,101, 102 Jack connector housing
110, 111 Plug connector-receiving openings
112 Rear jack connector housing side
113,114 Lateral jack connector housing sides
115,116 Engaging devices
117 Grooves
118 Assembly ribs
119 Fastening pins
180 Guiding channels
200 Jack connector subassembly
210 Lateral carrier plates
220 Signal pins
221 Signal pin end
250 Jack terminal carrier
251 Upper jack terminal carrier half

252 Lower jack terminal carrier half
253*a*, 253*b* Engaging means
254*a*,254*b* Engaging means
255 Electric/electronic components
260 Jack terminals
263 Jack terminal end
264 Radius area
265 Upper series of jack terminal contact portions
266 Lower series of jack terminal contact portions
268 Fixture arrangement
269 bump or knuckle
270 Horizontal shield plate
272 Soldering portion
272 Connecting tabs
280 Magnet box module
281 Box module
290 LED
291 Wave-guide
300 External shield housing
301-312 Plug connector passages
314 Shield tabs
315 Shield housing front portion
316 Projecting area
320 Shield housing-rear portion
321 Connecting tabs
322 Cutout area
325 Soldering lug
400 Earth plate
405 Soldering through hole
410 Signal pin through holes
500 Vertical shield plates
510 Soldering pin

The invention claimed is:

1. A modular electrical jack connector system comprising:

i) a first inside jack connector housing having a first side and a second side that face opposite to each other, ii) a first outside jack connector housing interconnected with the first inside jack connector housing at the first side, and iii) a second outside jack connector housing interconnected with the first inside jack connector housing at the second side; and a jack connector-subassembly inserted into each of the jack connector housing;

wherein the jack connector housings are configured as an assembly of modular adjacent connector housings that are arranged in a row; and wherein each of the jack connector housings comprises i) a front coupling side having at least two openings which openings are disposed one above the other for the purpose of receiving a plurality of electrical plug connectors through the front coupling side and ii) a rear side for the purpose of inserting the jack connector subassembly, the rear side being oppositely disposed with respect to the front coupling side; and wherein each jack connector subassembly comprises a longitudinal strip-like carrier having a substantially right-angled profile and having on the top and on the bottom respectively a series of extrusion-coated or injection-molded jack terminals, wherein the extrusion-coated or injection-molded jack terminals embody at a front end of the strip-like carrier uncoated and bent-back cantilevered contact portions, and wherein the uncoated and bent-back cantilevered contact portions are disposed aligned in an upper opening and/or into a lower opening of the jack connector housing.

2. The modular electrical jack connector system of claim 1 wherein each jack connector housing is formed out of a plastic material and is adapted for the purpose of receiving one jack connector subassembly.

3. The modular electrical jack connector system of claim 1 wherein respectively one metallic shield is inserted between individual adjacently strung jack connector housings.

4. The modular electrical jack connector system of claim 1 wherein the strip-like carrier is modularly constructed out of two stackable carrier halves wherein each half comprises an extrusion-coated or injection-molded arrangement of jack terminals.

5. The modular electrical jack connector system of claim 4 wherein a metallic shield plate is disposed sandwich-like between two carrier halves.

6. The modular electrical jack connector system of claim 1 wherein the extrusion-coating of the jack connectors up to the uncoated area of the contact portions forms a bump or knuckle-like thickening.

7. The modular electrical jack connector system of claim 1 wherein the strip-like carrier is modularly constructed out of two stackable identical carrier halves and wherein each carrier half respectively comprises a complementarily formed engaging device.

8. The modular electrical jack connector system of claim 1 wherein for the purpose of signal conditioning the jack connector subassembly comprises correspondingly adapted component modules which correspondingly adapted component modules are disposed at least adjacently with respect to a top surface of the strip-like carrier.

9. The modular electrical jack connector system of claim 1 wherein a plurality of different conditioning component modules is connectable with the jack connector subassembly.

10. The modular electrical jack connector system of claim 1 wherein the jack connector subassembly comprises a plurality of signal pins which signal pins extend outwards on one side.

11. The modular electrical jack connector system of claim 1 wherein the jack connector subassembly comprises pins for an inline power supply.

12. The modular electrical jack connector system of claim 1 wherein the jack connector subassembly comprises two separated carrier plates and particularly printed circuit boards for the purpose of mechanically holding together the components and their electrical circuitry encompassed by the jack connector subassembly.

13. The modular electrical jack connector system of claim 12, wherein between the carrier plates is disposed the strip-like carrier.

14. The modular electrical jack connector system of claim 12 wherein is disposed between the carrier plates at least one electrical/electronic components encompassing box-type module.

15. The modular electrical jack connector system of claim 12 wherein on the outside of the carrier plates are disposed electrical/electronic components.

16. The modular electrical jack connector system of claim 1 wherein the jack connector subassembly is equipped with LED pins.

17. The modular electrical jack connector system of claim 16 wherein the jack connector subassembly comprises at least one right-angularly radiating LED whose light is forwardly and outwardly guidable via a wave-guide to the front coupling side.

18. The modular electrical jack connector system of claim 17 wherein each of the jack connector housings is formed with guiding channels for the purpose of receiving the waveguide.

19. The modular electrical jack connector system of claim 1 wherein the jack connector housings are disposed on at least one earth plate and particularly a printed circuit board which printed circuit board comprises openings for the purpose of receiving guided signal pins of the jack connector subassembly.

20. The modular electrical jack connector system of claim 19 wherein the earth plate simultaneously carries further electrical/electronic components.

21. The modular electrical jack connector system of claim 19 wherein the earth plate comprises a sandwich-like multilayered composite structure.

22. The modular electrical jack connector system of claim 1 wherein the jack connector housings are encompassed by an external shield housing.

23. The modular electrical jack connector system of claim 22 wherein each inserted jack connector-subassembly is directly soldered to the external shield housing.

24. The modular electrical jack connector system of claim 22 wherein the external shield housing is constructed in two portions wherein the first portion is attachable to the jack connector housings from the front coupling side of the jack connector housings and wherein the second shield portion is solderable to the first portion and is attachable to the jack connector housings from the rear side of the jack connector housings.

25. The modular electrical jack connector system of claim 1 wherein for the purpose of arranging the jack connector housings adjacently, the jack connector housings comprise respectively complementarily developed fastening devices.

26. The modular electrical jack connector system of claim 1 wherein at least intermediately strung and/or stringable jack connector housings are identically constructed.

27. A jack connector housing for a modular electrical jack connector system, the jack connector housing comprising:

a first side and a second side that face opposite to each other, wherein the first side and the second side are adapted to interconnect with a first additional jack connector housing and a second additional jack connector housing, respectively;

a front coupling side having at least two openings which openings are disposed one above the other for the purpose of receiving a plurality of electrical plug connectors through to the front coupling side; and a rear side for the purpose of inserting a jack connector subassembly, the rear side being oppositely disposed with respect to the front coupling side;

wherein the jack connector housing is modularly arrangeable in a row with and adjacent to at least the first additional jack connector housing.

* * * * *

UNITED STATES PATENT AND TRADEMARK OFFICE

CERTIFICATE OF CORRECTION

PATENT NO. : 7,674,136 B2
APPLICATION NO. : 10/597434
DATED : March 9, 2010
INVENTOR(S) : Stephan Steinke et al.

It is certified that error appears in the above-identified patent and that said Letters Patent is hereby corrected as shown below:

On the Title Page, Item (86), replace with the following:

-- (86) PCT No.: PCT/EP2005/000703 --.

Signed and Sealed this
Twenty-first Day of July, 2015

Michelle K. Lee

Michelle K. Lee
*Director of the United States Patent and Trademark Office*